US008646381B2

(12) United States Patent
Donoho

(10) Patent No.: US 8,646,381 B2
(45) **Date of Patent: *Feb. 11, 2014**

(54) OVEN RACK AND DRIP PAN ASSEMBLY

(75) Inventor: Maureen Donoho, Goodlettsville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 1158 days.

This patent is subject to a terminal disclaimer.

(21) Appl. No.: 11/466,658

(22) Filed: Aug. 23, 2006

(65) Prior Publication Data

US 2008/0047441 A1 Feb. 28, 2008

(51) Int. Cl.
*A47J 37/07* (2006.01)

(52) U.S. Cl.
USPC ..... 99/400; 99/446; 126/339

(58) Field of Classification Search
USPC ..... 99/339, 340, 444–450, 348, 422–425, 99/326–333, 400; 126/21 R, 19 R, 39 R, 126/215, 275 R, 41 E, 337 R, 332, 337 A, 126/338, 339, 41 R, 333; 219/391, 400, 219/401; 211/181.1, 153, 126.15, 41.4, 211/90.01, 134, 90.03, 6.9, 414; D7/409, D7/323, 388, 402
See application file for complete search history.

(56) References Cited

U.S. PATENT DOCUMENTS

| | | | | |
|---|---|---|---|---|
| 1,889,218 | A | | 11/1932 | Reedy |
| 1,934,125 | A | | 11/1933 | Hurt |
| 1,961,391 | A | | 6/1934 | Reedy et al. |
| 2,058,864 | A | | 10/1936 | Goulooze |
| 2,122,275 | A | | 6/1938 | Bitney |
| 2,253,833 | A | * | 8/1941 | Volks ..... 99/446 |
| 2,335,279 | A | * | 11/1943 | Hobson ..... 126/39 B |
| 2,367,626 | A | * | 1/1945 | Shroyer et al. ..... 99/425 |
| 2,370,595 | A | * | 2/1945 | Volks ..... 99/423 |
| 2,430,848 | A | * | 11/1947 | Schneider ..... 126/41 R |
| 2,441,994 | A | * | 5/1948 | Di Pasquale ..... 126/275 R |
| 2,604,033 | A | * | 7/1952 | Chadwick et al. ..... 99/447 |
| 3,088,396 | A | * | 5/1963 | Proffitt ..... 99/443 R |
| 3,450,025 | A | | 6/1969 | Fleming |
| 3,527,154 | A | * | 9/1970 | Sharper et al. ..... 99/400 |
| 3,623,423 | A | | 11/1971 | Berger |
| 3,976,000 | A | | 8/1976 | Oxel |
| 4,238,669 | A | | 12/1980 | Huntley |
| 4,597,616 | A | | 7/1986 | Trubiano |
| 4,700,618 | A | | 10/1987 | Cox, Jr. |
| 4,909,137 | A | * | 3/1990 | Brugnoli ..... 99/444 |
| 5,203,254 | A | | 4/1993 | Fletcher |
| 5,211,105 | A | * | 5/1993 | Liu ..... 99/446 |
| 5,237,914 | A | * | 8/1993 | Carstensen ..... 99/445 |
| 5,339,728 | A | | 8/1994 | Marchwiak et al. |
| 5,555,795 | A | * | 9/1996 | Tsai ..... 99/446 |
| 6,187,359 | B1 | * | 2/2001 | Zuccarini ..... 426/505 |
| 6,362,458 | B1 | | 3/2002 | Sargunam et al. |

* cited by examiner

*Primary Examiner* — Reginald L Alexander
(74) *Attorney, Agent, or Firm* — Pearne & Gordon LLP

(57) ABSTRACT

An oven rack and drip pan assembly is provided in an appliance, such as an oven. The oven rack includes a support platform and a pair of drip pan rails extending downwardly from opposing sides of the support platform. The drip pan includes opposing side portions configured to be slidably received within the drip pan rails and a plurality of vented portions provided through a surface of the drip pan. The vented portions are configured to allow heated air to pass therethrough.

12 Claims, 11 Drawing Sheets

OVEN RACK AND DRIP PAN ASSEMBLY

RELATED APPLICATIONS

Not Applicable.

FIELD OF THE INVENTION

The present invention relates to racks for appliances, and more particularly, to a rack and drip pan assembly for an appliance, such as an oven.

BACKGROUND OF THE INVENTION

Appliances, such as ovens, often have one or more racks generally within the appliance. For example, the racks can be useful for the placing of cookware, food, and other items, within the oven. The racks can place the cookware generally towards the middle of the oven, and can keep the cookware away from heating elements and the like. In addition, ovens with multiple racks allow for placement of cookware on a variety of levels within the oven, thereby increasing the total volume of available cooking.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Appliance racks, and specifically oven racks, are often of wire form construction. More specifically, an outer wire frame and a support platform, which is constituted by a plurality of fore-to-aft and laterally spaced wires, define a typical oven rack. The wires are generally evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with one aspect of the present invention, an oven rack and drip pan assembly is provided in an appliance, such as an oven. The oven rack includes a support platform and a pair of drip pan rails extending downwardly from opposing sides of the support platform. The drip pan includes opposing side portions configured to be slidably received within the drip pan rails and a plurality of vented portions provided through a surface of the drip pan. The vented portions are configured to allow heated air to pass therethrough.

In accordance with another aspect of the present invention, an oven rack and drip pan assembly is provided. The oven rack includes a support platform having a support frame and a plurality of elongated support wires attached to the support frame to form a support surface extending along a substantially horizontal plane. A pair of drip pan rails is also provided. Each drip pan rail includes: a downwardly extending member from a front portion of the support platform; an inwardly extending member coupled to an end portion of the downwardly extending member; a drip pan support wire coupled to an end portion of the inwardly extending member, the drip pan support wire extending to a rear portion of the oven rack; and a stop member extending between an end of the drip pan support wire and a rear wire of the support platform. The drip pan is configured to be slidably supported by the drip pan rails. The drip pan includes a plurality of vented portions provided therein, the vented portions being configured to allow heated air to pass therethrough.

In accordance with yet another aspect of the present invention, an oven rack and drip pan is provided. The oven rack includes means for supporting a drip pan underneath a support platform of the oven rack. The drip pan includes means for allowing air to pass through a surface of the drip pan.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings.

DESCRIPTION OF AN EXAMPLE EMBODIMENT

Figure 1:
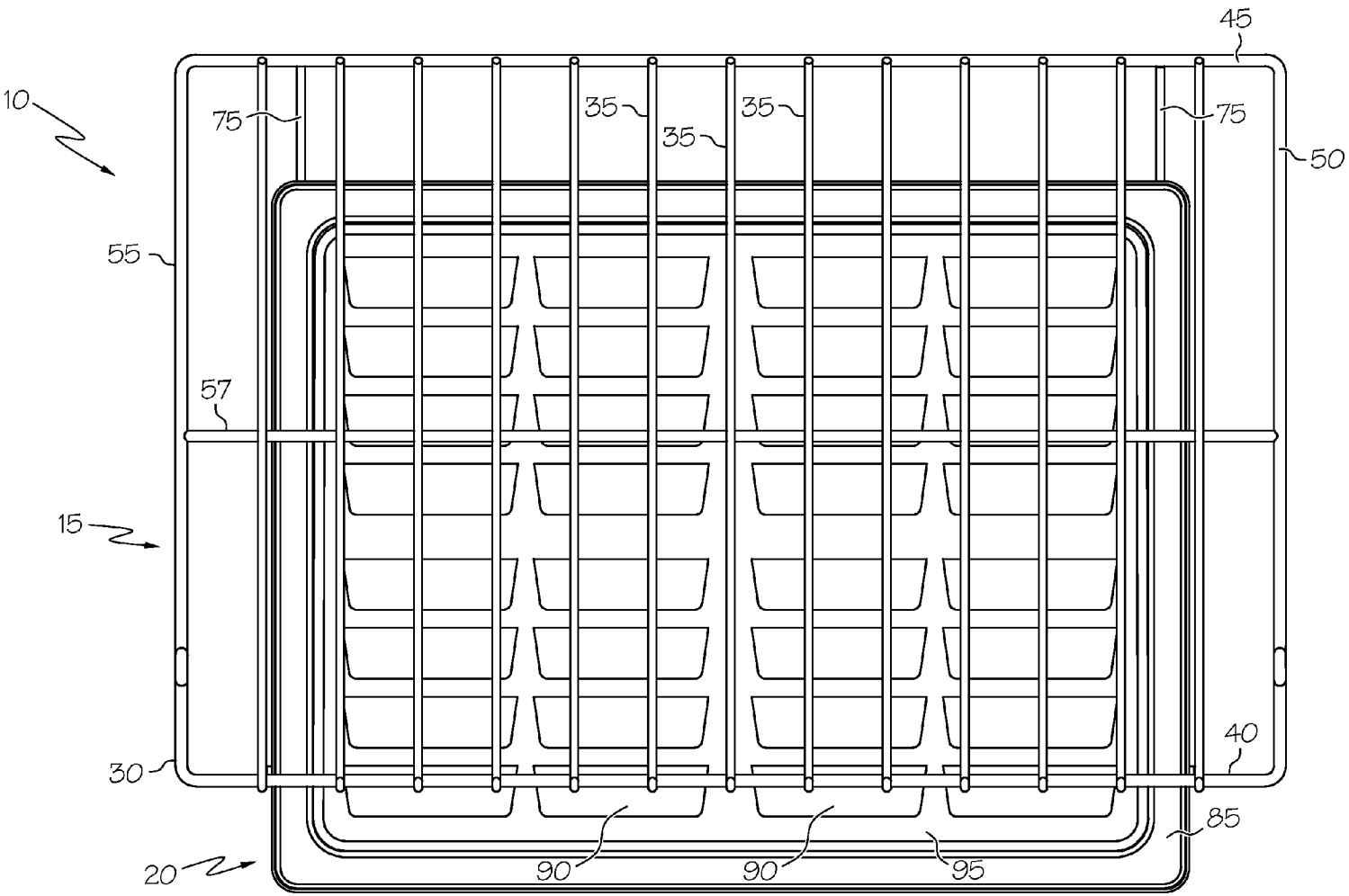
FIG. 1 illustrates a top view of an oven rack and drip pan assembly in accordance with an aspect of the present invention.

The present invention relates to a rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. It is also to be appreciated that the shown example is not intended to be a limitation on the present invention. For example, one or more aspects of the present invention can be utilized in other embodiments and even other types of racks.

Figure 2:
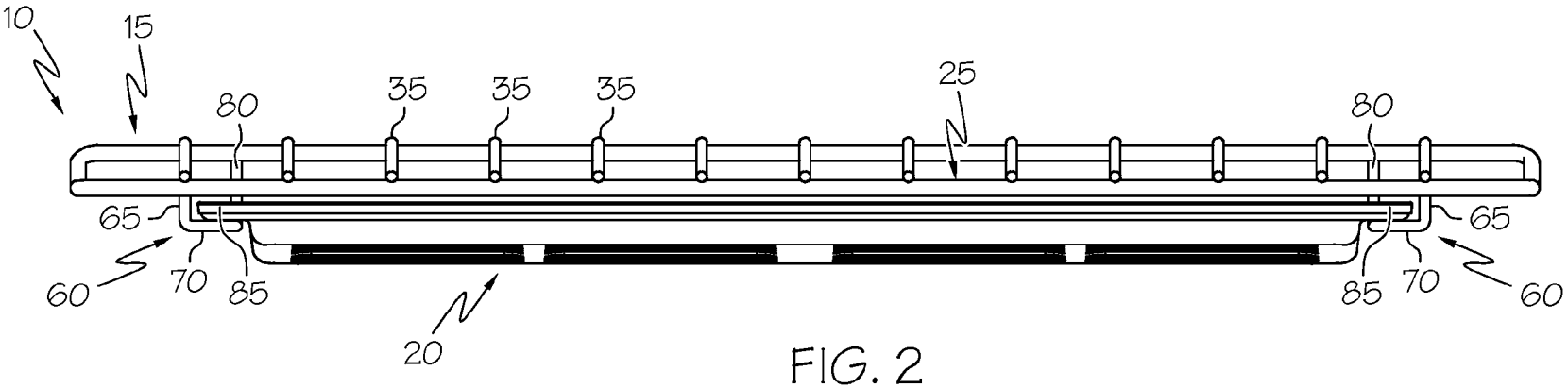
FIG. 2 illustrates a front view of the oven rack and drip pan assembly of FIG. 1 in accordance with an aspect of the present invention.
Figure 3:
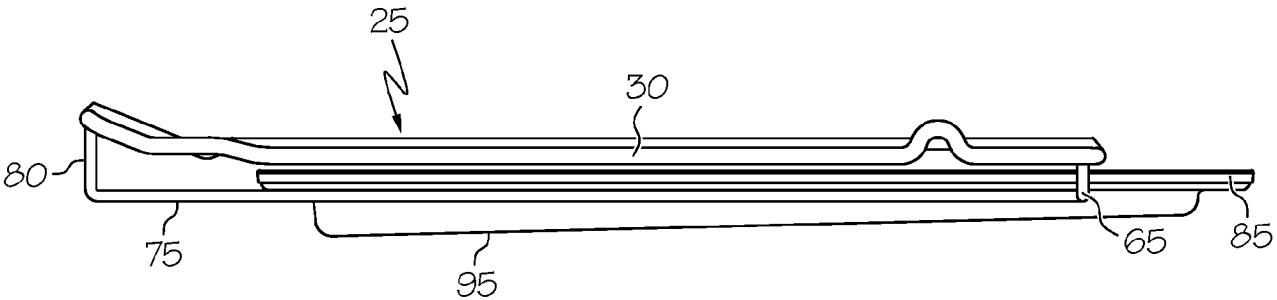
FIG. 3 illustrates a side view of the oven rack and drip pan assembly of FIG. 1 in accordance with an aspect of the present invention.
Figure 4:
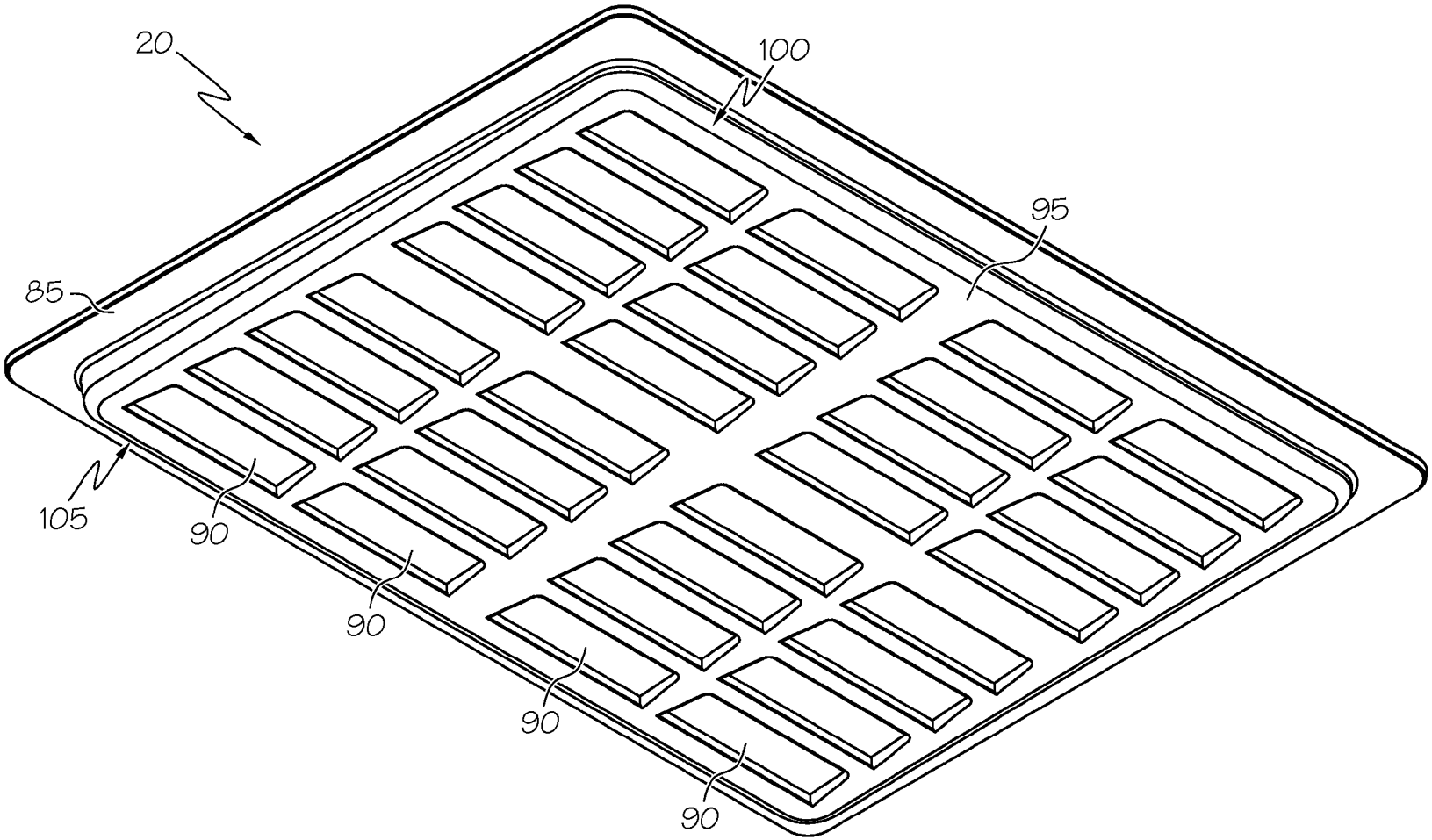
FIG. 4 illustrates a bottom perspective view of a drip pan for use with an oven rack in accordance with an aspect of the present invention.
Figure 5:
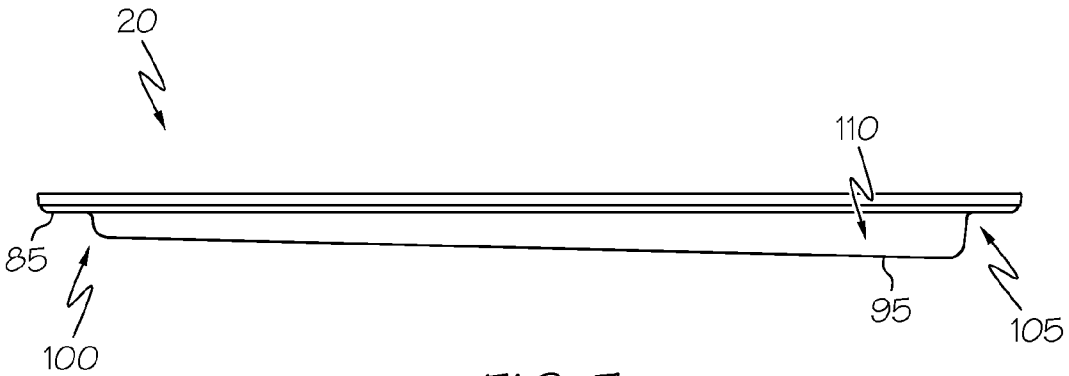
FIG. 5 illustrates a side view of the drip pan of FIG. 4 in accordance with an aspect of the present invention.
Figure 7:
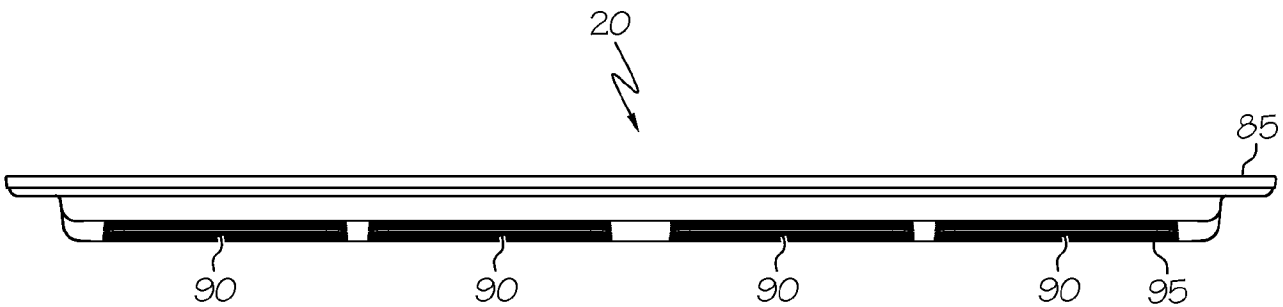
FIG. 7 illustrates a front view of the drip pan of FIG. 4 in accordance with an aspect of the present invention.
Figure 6:
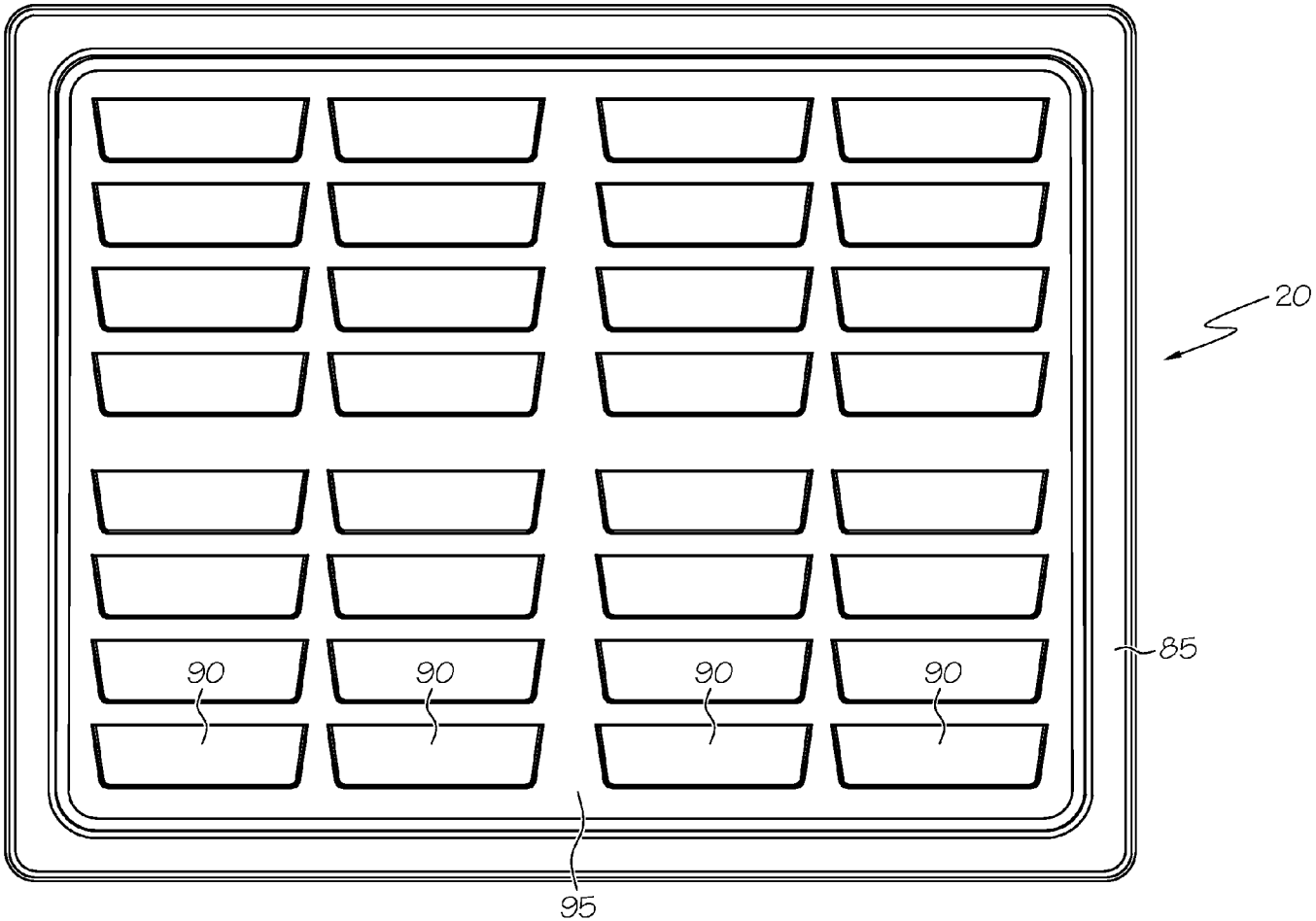
FIG. 6 illustrates a top view of the drip pan of FIG. 4 in accordance with an aspect of the present invention.
Figure 8:
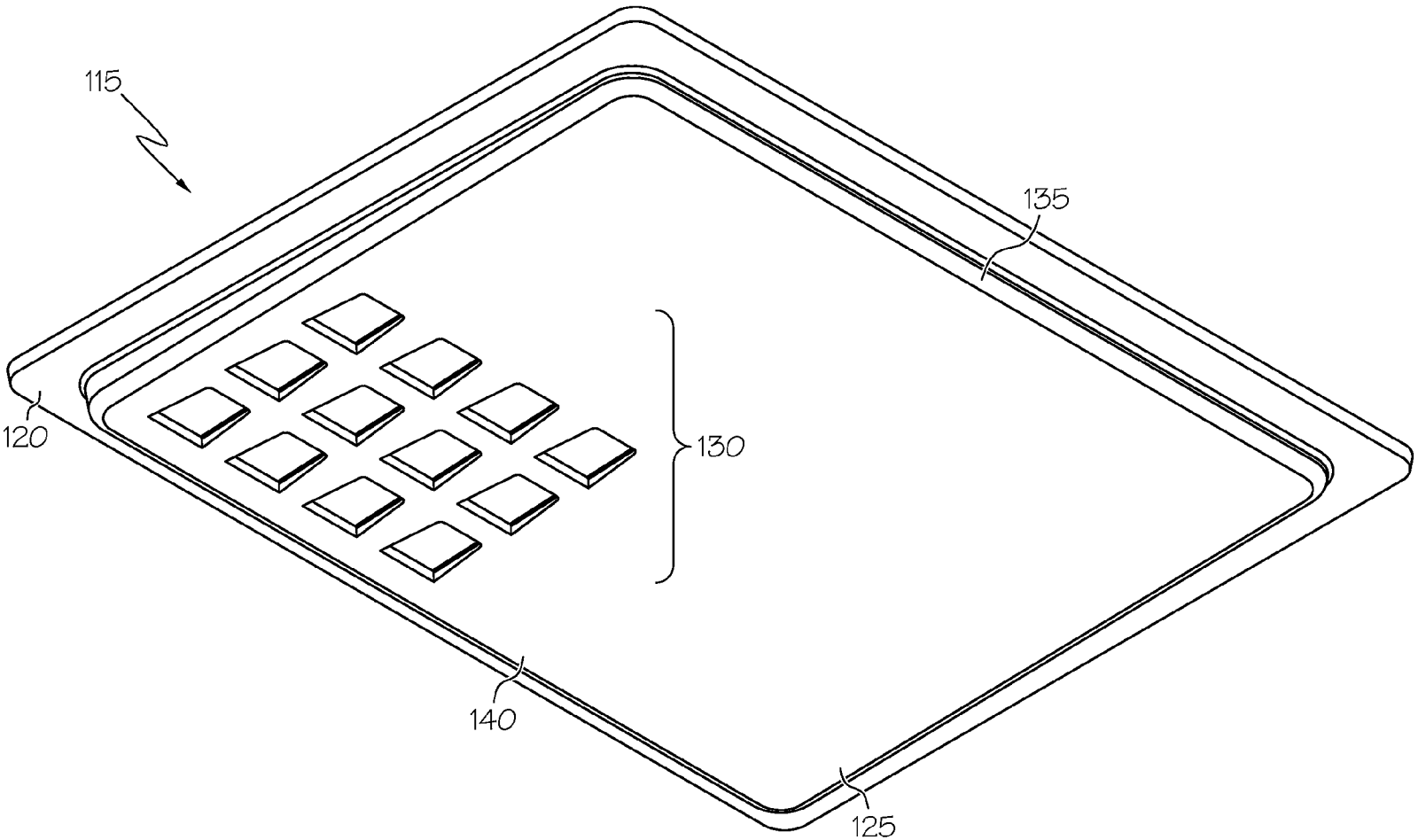
FIG. 8 illustrates a bottom perspective view of another drip pan for use with an oven rack in accordance with an aspect of the present invention.
Figure 9:
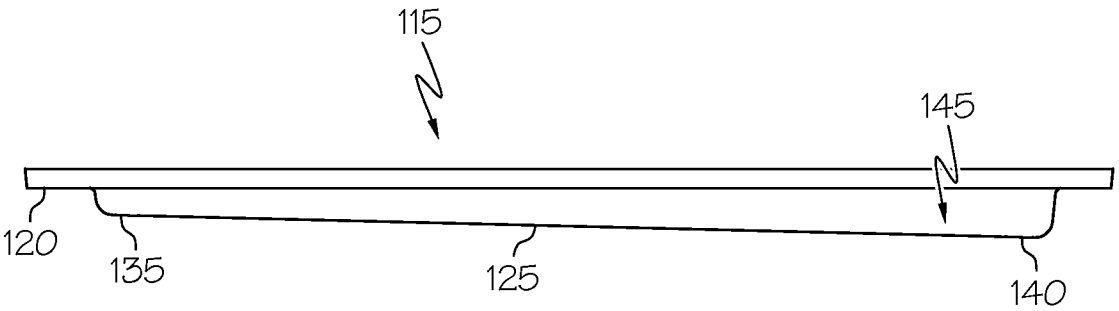
FIG. 9 illustrates a side view of the drip pan of FIG. 8 in accordance with an aspect of the present invention.
Figure 11:
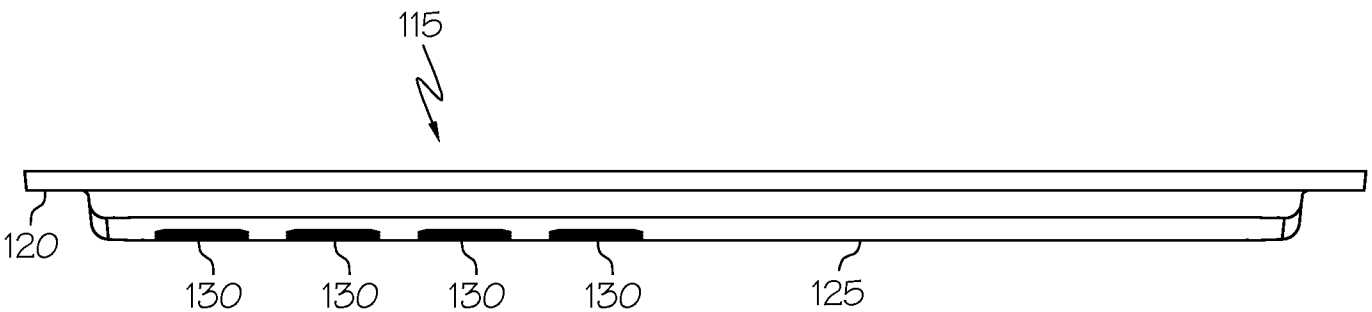
FIG. 11 illustrates a front view of the drip pan of FIG. 8 in accordance with an aspect of the present invention.
Figure 10:
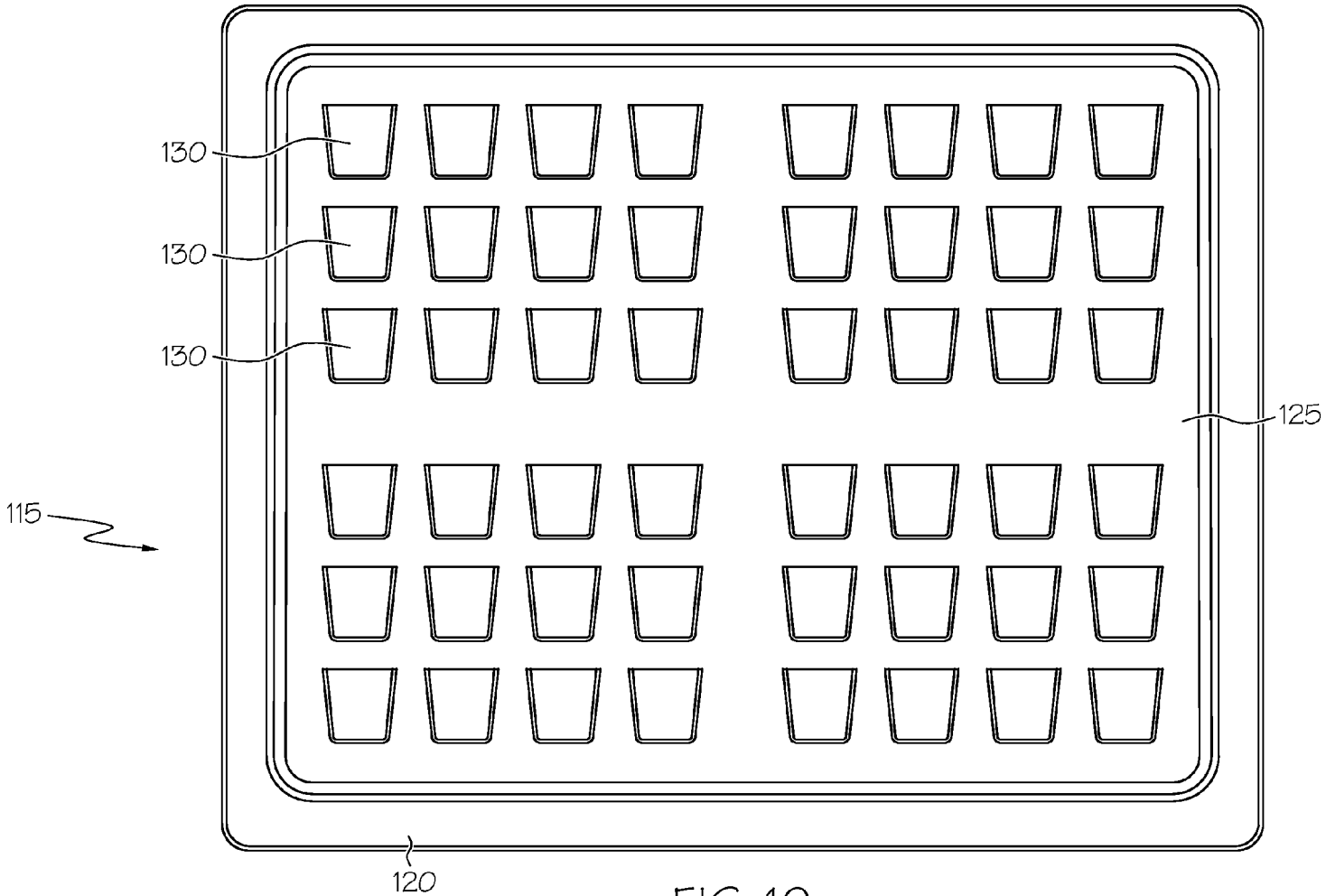
FIG. 10 illustrates a top view of the drip pan of FIG. 8 in accordance with an aspect of the present invention.
Figure 12:
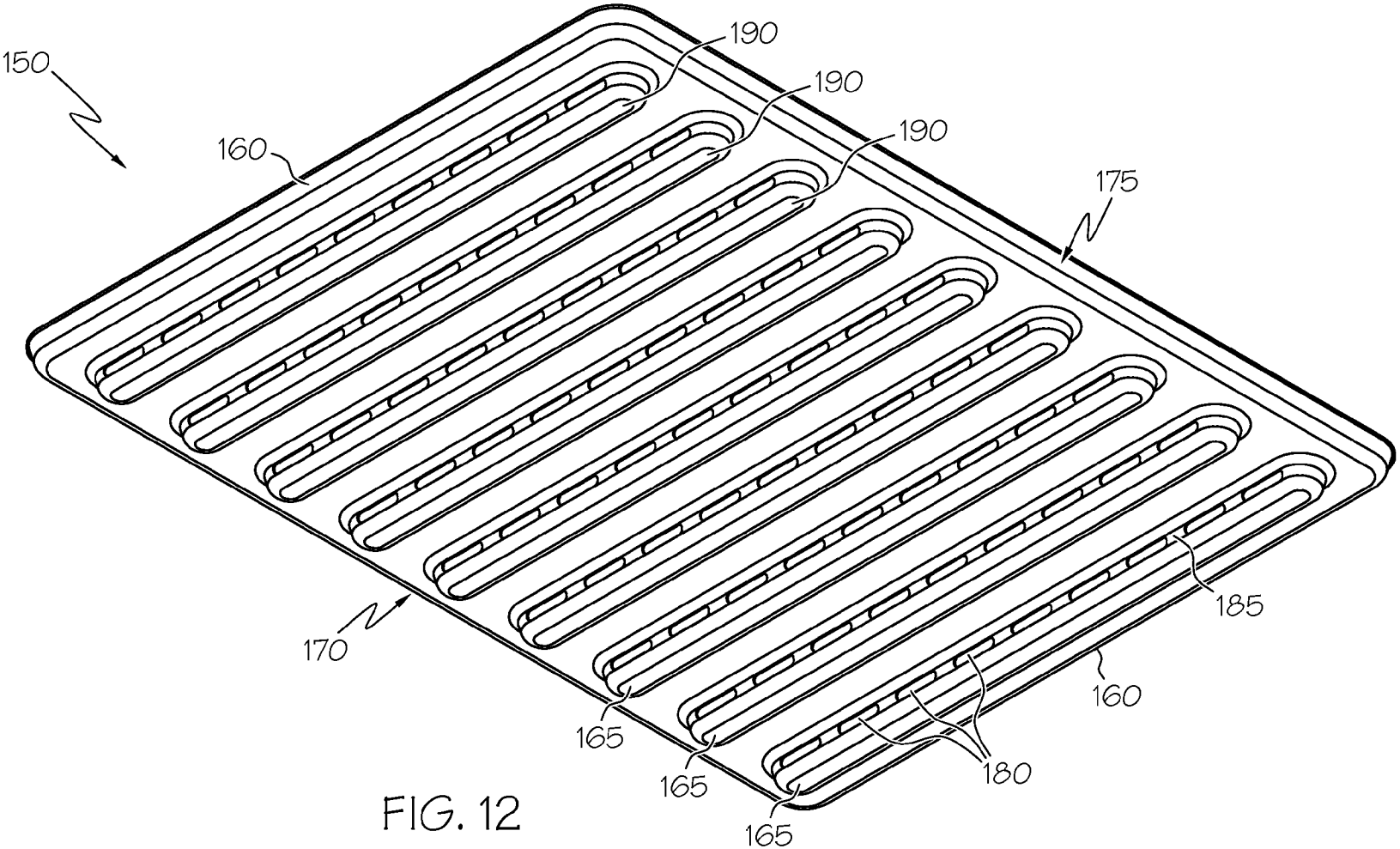
FIG. 12 illustrates a bottom perspective view of yet another drip pan for use with an oven rack in accordance with an aspect of the present invention.
Figure 13:
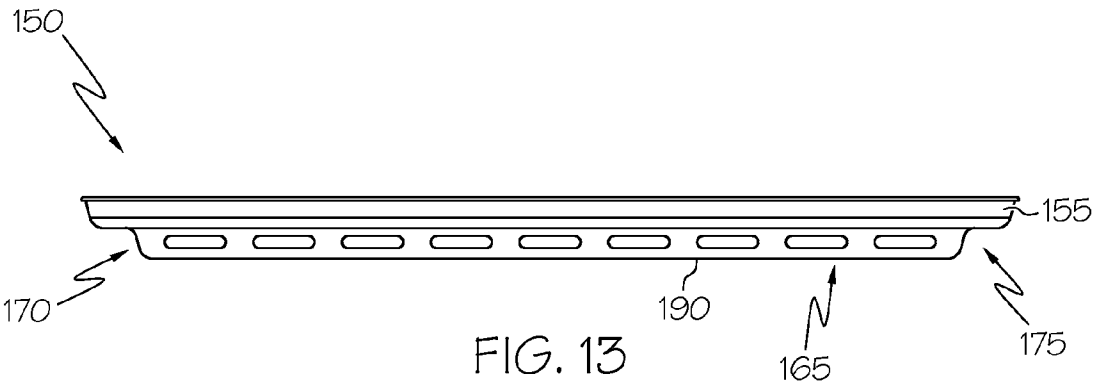
FIG. 13 illustrates a side view of the drip pan of FIG. 12 in accordance with an aspect of the present invention.
Figure 15:
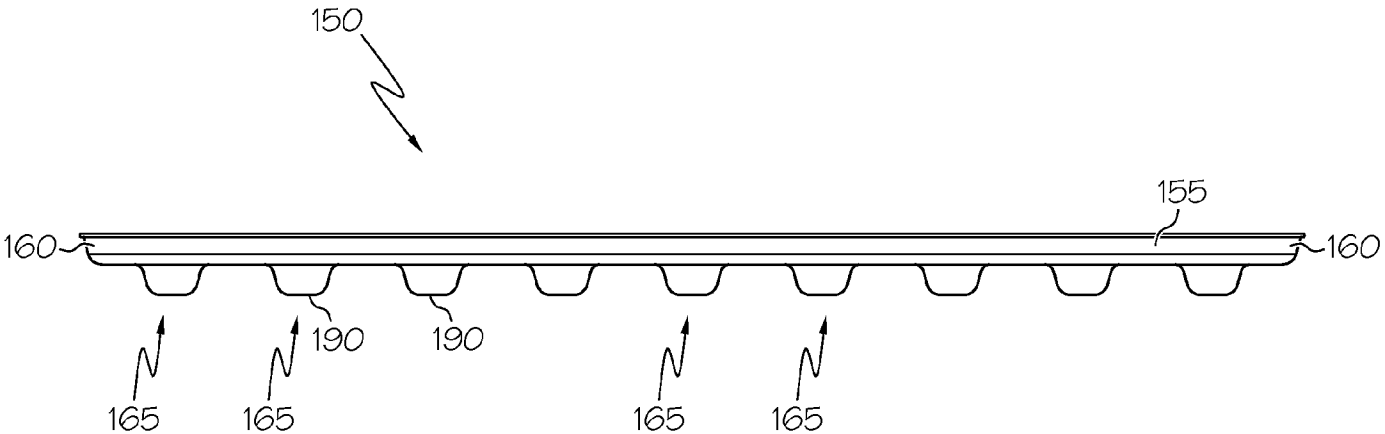
FIG. 15 illustrates a front view of the drip pan of FIG. 12 in accordance with an aspect of the present invention.
Figure 14:
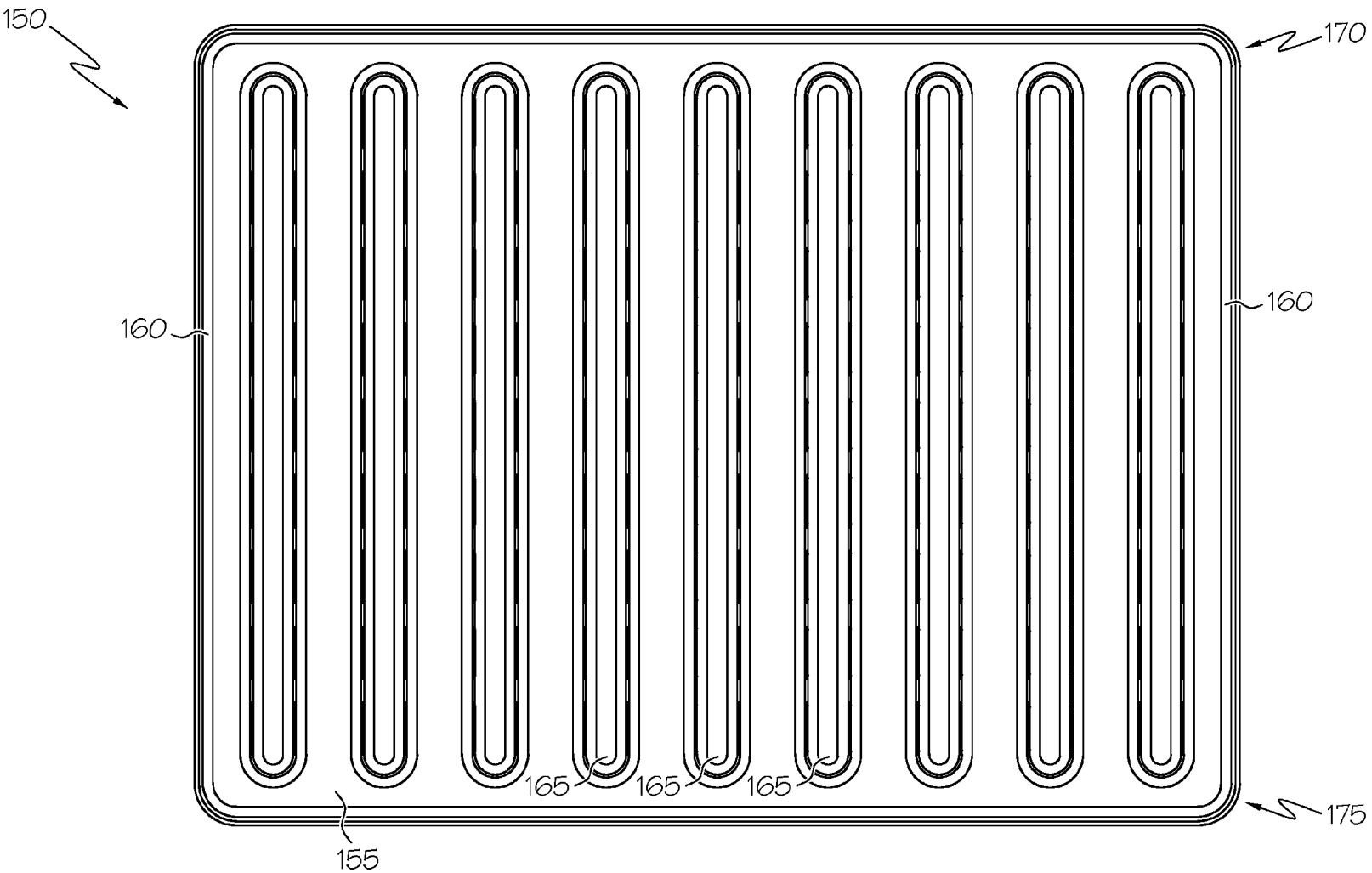
FIG. 14 illustrates a top view of the drip pan of FIG. 12 in accordance with an aspect of the present invention.

Referring initially to FIGS. 1-3, an example of an oven rack and drip pan assembly 10 for an appliance, such as an oven, is illustrated in accordance with an aspect of the present invention. The assembly 10 includes an oven rack 15 configured to slidably support a drip pan 20 on an underside thereof. The oven rack includes a support platform 25 formed by a support frame 30 and a plurality of elongated support wires 35. Both the support frame 30 and support wires 35 can be constructed from metal wire, such as iron coated with nickel or steel coated with porcelain. However, it is to be appreciated that the support frame 30 and support wires 35 can be constructed from various other suitable materials (e.g., various other metals and/or sheet metal).

The support frame 30 includes a front wire 40, a rear wire 45, and opposed side wires 50, 55. The front wire 40, rear wire 45, and side wires 50, 55 can be attached together to form the support frame 30 in various manners, such as by welding, adhesives, or fasteners, and/or can even be formed from a single piece of wire. The front wire 40, rear wire 45, and side wires 50, 55 can include single or multiple elements. As shown, the support frame 30 can have a generally rectangular geometry; through it is to be appreciated that the support frame 30 can have any other suitable geometry.

The plurality of elongated support wires 35 can be attached to the support frame 30. For instance, the elongated support wires 35 can be welded, or otherwise secured, to the support frame 30. It is to be appreciated that the elongated support wires 35 can extend between any of the front, rear, or side wires 40, 45, 50, 55 and can be oriented at various angles relative to the support frame 30. The elongated support wires 35 can be manufactured from metal wire or various other suitable materials, coated or uncoated, that provide adequate strength to support various items such as cake pans, baking stones, casseroles, or the like, and can withstand the heat of an oven. The elongated support wires 35 can form the support surface 25 extending along a substantially horizontal plane so as to provide an area configured to support various items, such as cake pans, cookie sheets, casseroles, and other suitable cookware.

The oven rack 15 can also include at least one cross member 57. The cross member 57 can be oriented at various angles relative to the elongated support wires 35. In one example, the cross member 57 can be oriented transverse to the support wires 35. Additionally, the cross member 57 can be attached to support frame 30 and/or the support wires 35 in various manners, including adhesives, fasteners, or welding, and/or can even be formed with either or both of the support frame 30 or support wires 35. The cross member 57 can also operate to mitigate sagging of the support platform 25 with respect to the support frame 30 when heavy food, cookware, or the like (not shown) is placed on the support platform 25. Thus, the cross member 57 can include various materials and/or geometries, such as a larger diameter wire.

The oven rack 15 further includes a pair of drip pan rails 60 extending downwardly from opposing sides of the support platform 25. Each of the drip pan rails 60 includes at least one downwardly extending member 65 from a front portion of the support platform 25. For instance, downwardly extending member 65 can extend from the front wire 40 or from a front portion of one of the support wires 35. Alternatively, the downwardly extending member 65 can extend from one of the side wires 50, 55. An inwardly extending member 70 extends from an end portion of the downwardly extending member 70 towards a center portion of the rack 15 and is substantially parallel with the front wire 40 of the support frame 30. From the inwardly extending member 70, at least one drip pan support wire 75 extends toward the rear portion of the oven rack 15 in a manner that is substantially parallel with the elongated support wires 35. A stop member 80 extends from a rear end portion of the drip pan support wire 75 to the rear wire 45. The stop member 80 prevents the drip pan 20 from being pushed beyond the rear portion of the oven rack 15. This configuration of the drip pan rails 60 allows the drip pan 20 to be slidably supported underneath the oven rack 15. More specifically, a flange or lip portion 85 of the drip pan 20 is configured to slidably engage the drip pan support wires 75. The lip portion 85 can extend around the entire periphery of the drip pan 20 or alternatively, the lip portion 85 can only be provided along opposing side portions of the drip pan 20 for engagement with the drip pan support wires 75.

Each of the drip pan rails 60 and its components can be attached to the support frame 30 using one or more various methods, such as by welding, adhesives, or fasteners, and/or can even be formed from a single piece of wire. In addition or alternatively, each of the drip pan rails 60 can be formed with the support frame 30. The drip pan rails 60 can be formed of metal wire, such as iron coated with nickel or steel coated with porcelain, or of various other suitable materials that provide adequate strength to support the drip pan 20 and that can withstand the heat of an oven.

Turning now to FIGS. 4-7, the drip pan 20 is illustrated in greater detail in accordance with an aspect of the invention. The drip pan 20 is configured to catch food particles, liquids and other food-related or other matter that may exit a food item or cooking or other vessel placed on the oven rack 15. The drip pan 20 collects such matter for easy clean up and to prevent such matter from entering the interior of the range. Accordingly, using the drip pan 20 can reduce the frequency of cleaning for an oven. However, because the drip pan 20 is supported under the oven rack 15, heat, which normally reaches the bottom of the cookware and/or food items is blocked by the structure of the drip pan 20. Accordingly, the drip pan 20 of the present invention includes a plurality of vented portions therein for allowing heat to pass through the drip pan 20. For instance, the drip pan 20 can include a plurality of louvers 90 formed in a bottom surface 95 of the pan 20. As shown in FIG. 1, four substantially parallel rows of eight louvers 90 are provided. However, it is to be appreciated that any number of louvers can be provided in any suitable configuration and is contemplated as falling within the scope of the present invention. The louvers 90 are configured to allow heat to pass from a bottom portion of the drip pan 20 through the louvers 90 and to a bottom portion of the cookware or food item that is supported on the support platform 25 of the oven rack 15. Moreover, the louvers 90 are configured to mitigate the accumulation of too much grease in the drip pan 20, which can create a fire hazard in the oven.

The drip pan 20 can be further configured such that the bottom surface 95 is sloped downwardly from a front portion 100 of the pan 20 to a rear portion 105 of the pan 20. The sloped bottom surface 95 facilitates collection of any drippings into a reservoir 110 formed at the rear portion 105 of the pan 20. Any suitable bottom surface configuration can be employed to form a reservoir in the drip pan. Alternatively, it is to be appreciated that the drip pan 20 can be formed with a substantially planar bottom surface such that no reservoir is formed.

The drip pan 20 is of a generally rectangular configuration and can be made of a heat conducting material, such as metal, and may be chrome-plated or polished for aesthetic reasons or coated with a non-stick substance to ease removal of drippings. However, it is to be appreciated that the drip pan 20 can of any desired shape and size and can be made of any other suitable material or combination of materials able to withstand the heat of an oven.

FIGS. 8-11 depict another example of a drip pan 115 that can be used in an oven rack and drip pan assembly in accordance with an aspect of the present invention is illustrated. The drip pan 115 includes a flange or lip portion 120 that extends around a periphery of the drip pan 115. The lip portion 120 is configured to slidably engage a pair of drip pan rails (not shown) extending below an oven rack (not shown) such that the drip pan 115 can be supported under the oven rack to collect drippings and the like. Although the lip portion 120 is shown as extending around the entire periphery of the drip pan 115, it is to be appreciated that the lip portion can only be present on two opposing sides of the drip pan 115 for engagement with the drip pan rails. Any other suitable configuration of the lip portion for engagement with the drip pan rails is also contemplated.

As shown, the drip pan 115 further includes a bottom surface 125 that is recessed from the lip portion 120. The bottom surface 125 has a plurality of vented portions, such as louvers, 130 formed therein. The louvers 130 are configured to allow heat from the oven to pass through the bottom surface 125 of the drip pan 115 to reach the food item(s) or cookware provided on the oven rack. The louvers 130 are further configured to mitigate excessive accumulation of grease within the drip pan 115, which can create unsafe oven conditions, such as a grease fire. The drip pan can include louvers of any suitable size, configuration, and number and is contemplated as falling within the scope of the present invention.

The bottom surface 125 of the drip pan 115 can also be downwardly sloped from a front portion 135 of the drip pan 115 to a rear portion 140 of the drip pan 115 to create a reservoir 145 at the rear portion 140. Drippings from food item(s) and/or cookware on the oven rack can thus flow from the front 135 of the drip pan to the reservoir 145 for collection thereof.

Turning now to FIGS. 12-15, yet another example of a drip pan 150 for use in an oven rack and drip pan assembly is illustrated in accordance with an aspect of the present invention. The drip pan 150 includes a top portion 155, the sides 160 of which are configured to slidably engage a pair of drip pan rails (not shown) extending below an oven rack (not shown) such that the drip pan 150 can be supported under the oven rack.

A plurality of depressions 165 are formed in the drip pan 150 and are configured to collect drippings and the like. As shown, the depressions 165 can be provided in the shape of elongated channels or troughs that extend between a rear portion 170 of the drip pan 150 and a front portion 175 of the drip pan 150. It is to be appreciated that the depressions 165 can be of any suitable shape and size to collect drippings from food item(s) and/or cookware placed on the oven rack. A plurality of vents 180 are provided through sidewalls 185 of the depressions 165. The vents 180 can be slotted apertures formed in one or more sidewalls of the depressions and are configured to allow heat from the oven to pass through the vents 180 of the drip pan 150 to reach the food item(s) or cookware provided on the oven rack. The vents 180 are further configured to mitigate excessive accumulation of grease within the depressions 165, which can create unsafe oven conditions, such as a grease fire. The depressions 165 can include vents of any suitable size, configuration, and number and is contemplated as falling within the scope of the present invention. Further, the vents 180 are provided in the sidewalls 185 of the depressions 165 so that a bottom portion 190 of the depressions 165 create a reservoir therein. Accordingly, drippings from food item(s) and/or cookware on the oven rack can collect within these reservoirs. The amount of drippings that can collect in the reservoirs is limited by the sidewall vents 180.

It is to be appreciated that the oven rack and drip pan assembly of the subject invention can be used in settings other than in an oven. For example, the assembly of the subject invention could be used in a refrigerator and/or freezer unit. Further, it is to be appreciated that the assembly can be constructed of any suitable material, such as metal, plastic, and the like. Further still, the frame, the bars, and the cross-member(s) need not be constructed from the same materials.

The size of the oven rack and drip pan assembly of the subject invention also depends upon the intended use of the assembly. In the example embodiments, the oven rack is sized to slide into or replace an oven rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. An oven rack and drip pan assembly for an appliance comprising;

an oven rack including:

a support platform on which food is to rest during cooking; and a pair of drip pan rails extending downwardly from opposing sides of the support platform; and a drip pan including:

opposing side portions configured to be slidably received within the drip pan rails; and a plurality of vented portions provided through a surface of the drip pan, the plurality of vented portions being configured to allow heated air to pass therethrough and to prevent matter from entering an interior of the appliance, wherein the plurality of vented portions includes louvers provided in a bottom surface of the drip pan, the drip pan includes a front portion and an opposed rear portion, a bottom surface of the drip pan slopes gradually from the front portion to the rear portion, and at least one reservoir is formed at the rear portion of the drip pan at a location along the bottom surface of the drip pan toward which the bottom surface is sloped where the matter on the bottom surface is to be collected on the drip pan, and wherein the plurality of louvers each include a top surface that is sloped relative to the bottom surface of the drip pin to interfere with passage of the matter on the top surface through the vented portions as the matter travels in a direction from the front portion of the drip pan toward the reservoir.

2. The oven rack and drip pan assembly of claim 1, wherein the at least one reservoir is configured to collect drippings therein.

3. The oven rack and drip pan assembly of claim 2, wherein the plurality of vented portions includes apertures formed in at least one sidewall of the at least one reservoir.

4. The oven rack and drip pan assembly of claim 2, wherein the at least one reservoir is formed by a depression in the bottom surface of the drip pan.

5. The oven rack and drip pan assembly of claim 1, wherein each of the drip pan rails includes at least one drip pan support wire upon which the drip pan can be slidably supported.

6. The oven rack and drip pan assembly of claim 5, wherein the drip pan includes a lip portion around a periphery thereof, the lip portion being slidably engaged with the at least one drip pan support wire.

7. The oven rack and drip pan assembly of claim 1, wherein the oven rack comprises a plurality of elongated support wires attached to a support frame.

8. An oven rack and drip pan assembly for an appliance comprising;

an oven rack having a support platform having a support frame and a plurality of elongated support wires attached to the support frame to form a support surface extending along a substantially horizontal plane;

a pair of drip pan rails, each drip pan rail comprising:

a downwardly extending member from a front portion of the support platform;

an inwardly extending member coupled to an end portion of the downwardly extending member;

a drip pan support wire coupled to an end portion of the inwardly extending member, the drip pan support wire extending to a rear portion of the oven rack; and a stop member extending between an end of the drip pan support wire and a rear wire of the support platform; and a drip pan configured to be slidably supported by the drip pan rails, the drip pan having a plurality of vented portions provided therein, the vented portions being configured to allow heated air to pass therethrough and a plurality of troughs, wherein the vented portions are provided within at least one sidewall of each trough and wherein a top surface and bottom surface of each trough is free from vented portions.

9. The oven rack and drip pan assembly of claim 8, wherein a bottom surface of the drip pan is downwardly sloped from a front portion of the drip pan to a rear portion of the drip pan.

10. The oven rack and drip pan assembly of claim 8, wherein the drip pan includes at least one flange provided on at least two sides of the drip pan, the at least one flange being configured to slidably engage the drip pan support wires.

11. The oven rack and drip pan assembly of claim 8, wherein the plurality of troughs are elongated channels formed in a bottom surface of the drip pan.

12. The oven rack and drip pan assembly of claim 11, wherein the elongated channels extend from a front portion of the drip pan to a rear portion of the drip pan.

* * * * *